US008449079B2

(12) United States Patent
Ge et al.

(10) Patent No.: US 8,449,079 B2
(45) Date of Patent: May 28, 2013

(54) FLUID EJECTION DEVICE HAVING FIRST AND SECOND RESISTORS

(75) Inventors: Ning Ge, Singapore (SG); Trudy Benjamin, Portland, OR (US); Adam L Ghozeil, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/231,634

(22) Filed: Sep. 13, 2011

(65) Prior Publication Data

US 2013/0063527 A1 Mar. 14, 2013

(51) Int. Cl.
*B41J 2/05* (2006.01)

(52) U.S. Cl.
USPC ..... 347/62

(58) Field of Classification Search
CPC ..... B41J 2/14024; B41J 2/1623
USPC ..... 347/54, 56, 61–63, 65
See application file for complete search history.

(56) References Cited

U.S. PATENT DOCUMENTS

| | | | | |
|---|---|---|---|---|
| 7,207,662 | B2 * | 4/2007 | Shin et al. | 347/63 |
| 7,401,903 | B2 | 7/2008 | Silverbrook | |
| 7,488,056 | B2 * | 2/2009 | Torgerson et al. | 347/58 |
| 7,517,060 | B2 * | 4/2009 | Hess et al. | 347/64 |
| 7,810,911 | B2 | 10/2010 | Shim et al. | |
| 7,909,428 | B2 | 3/2011 | Donaldson et al. | |
| 2008/0094455 | A1 | 4/2008 | Lee et al. | |

FOREIGN PATENT DOCUMENTS

JP 2005212134 A 8/2005

* cited by examiner

*Primary Examiner* — An Do

(57) ABSTRACT

A fluid ejection device includes a first resistor layer that has at least a first resistor for heating fluid and a second resistor layer that has at least a second resistor for heating fluid. There is an electrically insulating layer formed between the first and second resistor layers. A print cartridge for a printer contains a fluid container and a printhead, at least one nozzle, a first resistor layer that has at least a first resistor for pre-heating or thermally ejecting fluid, a second resistor layer that has at least a second resistor for pre-heating or thermally ejecting fluid, and an electrically insulating layer formed between the first and second resistor layers.

19 Claims, 7 Drawing Sheets

FLUID EJECTION DEVICE HAVING FIRST AND SECOND RESISTORS

BACKGROUND OF THE INVENTION

An ink jet printhead is one example of a fluid ejection device. Applications include, but are not limited to printers, graphic plotters, copiers and facsimile machines. Such apparatus use an ink jet printhead to shoot ink or another material onto a medium, such as paper, to form a desired image. More generally a fluid ejection device is a precision dispensing device that precisely dispenses fluids such as ink, wax, polymers or other fluids. While printing to form an image on a surface is a well known application, fluid ejection devices are not limited to this and may be used for other purposes, such as manufacturing or 3D printing for instance.

Fluid ejection devices may eject the fluid by any suitable method, for instance thermal expansion of the fluid or a piezoelectric pressure wave. A thermal fluid ejection device typically heats a resistor causing fluid in a chamber near the resistor to evaporate and form a bubble. Pressure from the bubble causes fluid to be ejected through a nozzle of the fluid ejection device.

It can be useful for a fluid ejection device to be able to generate different sizes of fluid droplet. Smaller fluid droplets can be used for high resolution, while larger fluid droplets may be used to efficiently cover larger areas for instance. The size of the fluid droplet ejected through the nozzle depends, inter-alia, on the size of the resistor. A larger resistor will in general generate a larger bubble displacing more fluid and thus produce a larger fluid droplet. Some fluid ejection devices have two different sizes of resistor in order to produce two different sizes of fluid droplet. However, having two different sizes of resistor takes up a lot of space while only limited space may be available on the fluid ejection device.

BRIEF DESCRIPTION OF THE DRAWINGS

Some examples are described in the following figures:

FIG. 1 (*b*) shows a resistor from FIG. 1(*a*) in detail;

FIG. 1 (*c*) is a cross sectional view of the resistor of FIG. 1 (*b*);

FIG. 1 (*d*) is a cross sectional view of an alternative structure of resistor;

FIG. 3 (*b*) is a flow diagram of a method of ejecting fluid according to the present disclosure;

FIG. 3 (*c*) is a flow diagram of a method of ejecting fluid according to the present disclosure;

FIG. 4 (*b*) is a flowchart of an example method of forming the first resistor layer; and FIG. 4 (*c*) is a flowchart of an example method of forming the second resistor layer.

DETAILED DESCRIPTION

Figure 1A:
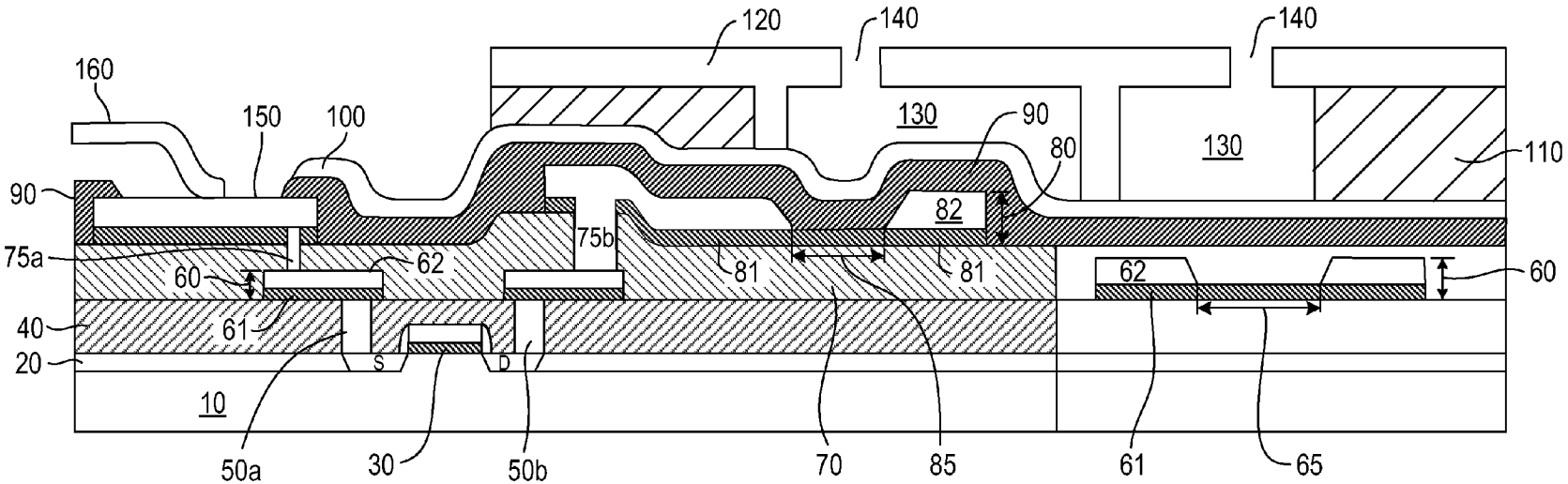
FIG. 1 (*a*) is a cross sectional diagram of part of a fluid ejection device according to the present disclosure.
Figure 1B:
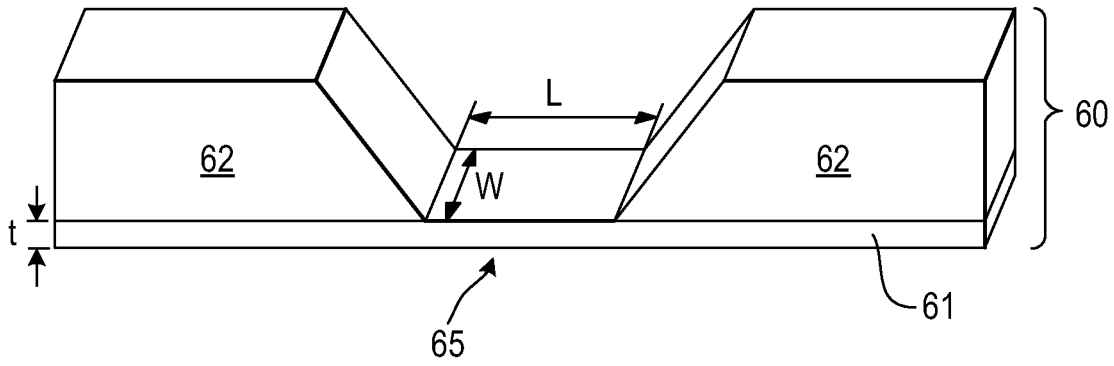
Figure 1C:
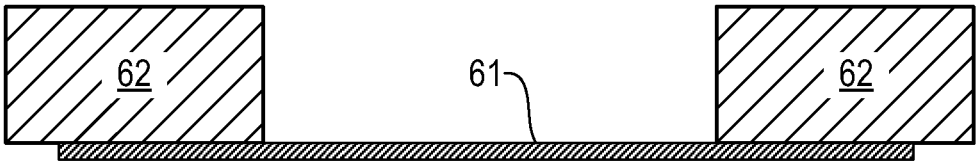
Figure 1D:
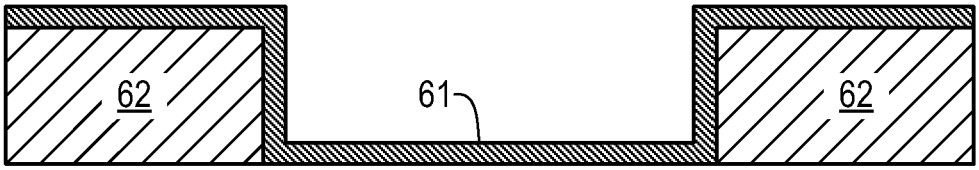

FIG. 1(*a*) shows a partial cross section of a fluid ejection device, such as a thermal ink jet (TIJ) print head, according to one example. The fluid ejection device has a plate 120 and a barrier layer 110 which defines a chamber 130 into which fluid (such as, but not limited to ink) may flow. If fluid in the chamber is sufficiently heated, part of the fluid vaporizes to form a bubble, causing fluid above the bubble to be ejected through a nozzle (e.g. an orifice) 140 in plate 120.

In FIG. 1(*a*) the fluid ejection device has two resistor layers denoted generally by reference numerals 60 and 80 respectively. A resistor layer is a layer having one or more resistors for heating fluid Each resistor may be heated by passing electrical current so as to thermally eject fluid through a nozzle of the device or so as to pre-heat fluid in its vicinity. An electrically insulating layer 70 (such as, but not limited to, silicon dioxide for example) is provided between the first and second resistor layers. A further electrically insulating layer 90 is provided above the second resistor layer. The purpose of the insulating layer 90 is to shield the second resistor layer from the fluid and prevent short circuits, as many fluids such as printer inks are conductive. An anti-cavitation layer 100 (such as, but not limited to, Tantalum) is provided between the chamber 130 and the second resistor layer 80. The anti-cavitation layer 100 helps to prevent mechanical damage to the resistors due to forces generated during collapse of a fluid bubble in the chamber.

Beneath the first resistor layer 60, there is an isolation layer 40 (such as, but not limited to, a silicon oxide for example). Beneath the isolation layer there is a thermal isolation layer 20 (e.g. silicon dioxide) and a transistor 30. Finally there is the substrate 10 on which the other layers are based. The layers are typically formed by a deposition process and etching, as will be discussed in more detail later.

A resistor may be heated (fired) by sending a current pulse through it. Any appropriate method may be used to direct a current pulse to the desired resistor, for example direct addressing, matrix addressing or a smart drive chip in the fluid ejection device. Selection of which resistor to fire may be carried out by a processor in the fluid ejection device, a processor in a related controlling device such as a printer, or a combination thereof. Once it has been determined to heat a particular resistor, a pulse of electric current can be delivered to the resistor through circuitry in the fluid ejection device.

FIG. 1(*a*) shows an example in which a current pulse may be delivered to second resistor 85 through a bonding wire 160 which is connected to a bond pad 150. From the bond pad 150, the conducting line goes through via 75*a*, a portion of the first resistor layer 60, via 50*a*, source S and drain D of transistor 30, via 50*b*, another portion of the first resistor layer 60, and via 75*b*, and a portion of the second resistor layer 80 to the second resistor 85. The first resistor 65 may be connected by a similar path to another bond pad (not shown). As FIG. 1 (*a*) is just a 2D cross section, while the actual fluid ejection device is 3D, there is room to provide various circuits to connect bond pads to different resistors. Of course the signal route described above and shown in FIG. 1(*a*) is an example only and variations and other configurations are possible.

For simplicity, in the example of FIG. 1, only one resistor 65 is shown in the first resistor layer 60 and one resistor 85 is shown in the second resistor layer 80. However, each resistor layer 60, 80 may have a large number of resistors (e.g. several hundred) each at a different location in the layer. By selecting the appropriate resistor to fire, fluid in a particular desired location maybe pre-heated or ejected through a nearby nozzle.

Various structures of resistor are possible. In the example of FIG. 1 (*a*) the first resistor layer 60 comprises sub-layers: a first conductive layer 61 and a second conductive layer 62. Both layers 61 and 62 are electrically conductive, but the first conductive layer 61 has a higher sheet resistance than the second conductive layer 62 (sheet resistance is resistance per unit). Where both first and second conductive layers 61, 62 are present the majority of the current goes through the second conductive layer 62 which acts as a conducting line and may be used for routing signals. The structure of FIG. 1 (*a*) may for example be formed by depositing the first conductive layer, depositing the second conductive layer and then etching the second conductive layer to form a gap with portions on either side of the gap linked by the first conductive layer.

FIG. 1 (*b*) shows an example structure for a resistor 65 from the first resistor layer 60 in more detail. A portion of the second conductive layer 62 has been removed so that electric current flowing from left to right in FIG. 1 (*b*) must pass through the first conductive layer 61. The structure thus acts as a resistor enabling a specific location in the fluid ejection device to be heated by passing a pulse of current. When the resistor is fired in this way it heats any fluid in the chamber above.

Similarly the second resistor layer 80 may comprise a third conductive layer 81 and a fourth conductive layer 82; the third conductive layer 81 having a higher sheet resistance than the fourth conductive layer 82. The fourth conductive layer 82 acts a conducting line and may be used for routing signals. The second resistor 85 in the second resistor layer 80 has the same structure as described above and shown in FIG. 1 (*b*), but with third and fourth conductive layers 81, 82.

FIG. 1 (*c*) shows a cross sectional view of the resistor of FIG. 1 (*b*). FIG. 1 (*d*) shows a cross sectional view of an alternative structure of resistor. In this case the first conductive layer 61 (having higher sheet resistance) extends over the second conductive layer 62. For instance it could be formed by first depositing the second layer 62, then etching the second layer and then depositing the first layer 61. While several examples of resistor structures have been described above, it is noted that the fluid ejection devices of the present disclosure are not limited to these types of resistor and various other structures and configurations are possible.

The fluid ejection device according to the present disclosure has two resistor layers 60, 80. Each resistor layer has one or more resistors which may be heated for the purpose of pre-heating or thermally ejecting fluid from the device. FIG. 1 (*a*) shows a first resistor 65 in the first resistor layer and a second resistor 85 in the second resistor layer. Various arrangements are possible and within the scope of the present disclosure. The first resistor 65 may be formed from the same material as the second resistor 85 or from a different material. The first resistor 65 may have the same area as the second resistor 85 or a different area. The first resistor may have the same thickness as the second resistor or a different thickness. The first resistor may have the same resistance as the second resistor or a different resistance. Further, while in the examples of FIG. 1 (*a*) and FIG. 2, the first and second resistor layers 60, 80 are separated only by an insulating layer 70, it would be possible to have one or more further intermediate layers. For example, there could be one or more routing layers (of conductive material for routing signals) and insulating layers between the first and second resistor layers.

Having two (or more) resistor layers 60, 80 has several advantages. It may make it possible to provide more flexibility in circuit design and/or options for routing signals to the resistors. In some implementations the presence of two resistor layers makes it possible to vary the fluid droplet size and/or carefully control pre-heating of fluid in the chamber before firing, as will be explained below. The size of the fluid droplet ejected from the fluid ejection device depends, inter-alia, upon the size of the nozzle, the area of the resistor (length*width) and the quantity of heat generated by the resistor. The quantity of heat depends upon the size of the current and the resistance of the resistor. The higher the resistance the more heat is generated for a given current and the larger the fluid droplet.

Thus, one way to produce fluid droplet of different sizes is to vary the current pulse size. If the first and second resistors have the same resistance and area, they will generally produce the same size of fluid droplet when fired with the same size of current pulse (e.g. same current amplitude and area). However they will produce different size fluid droplets if they are fired by different size current pulses.

Another way to produce different droplet sizes is to tune the first and second resistors to produce different droplet sizes, even when they are fired with like current pulses. For example, the first resistor may be tuned to produce a larger fluid droplet than the second resistor. By 'tuned' to produce a larger droplet it is meant that the first resistor has physical characteristics (e.g. a larger resistance and/or larger area) that will cause it to produce a larger fluid droplet than the second resistor when fired with the same current. Tuning the resistors in this way is useful as it means that the circuitry can produce different droplet sizes simply by directing the same size current pulse to different resistors.

Figure 3A:
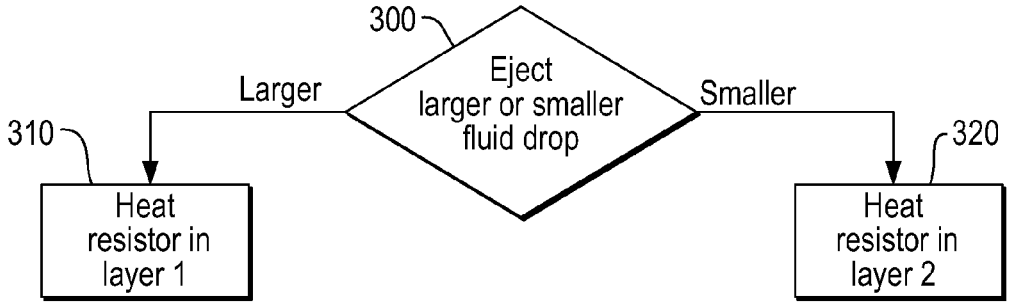
FIG. 3 (*a*) is a flow diagram of a method of ejecting fluid according to the present disclosure.
Figure 3B:
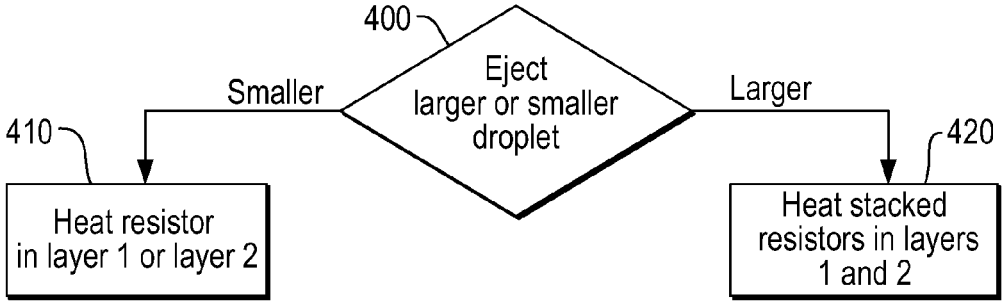
Figure 3C:
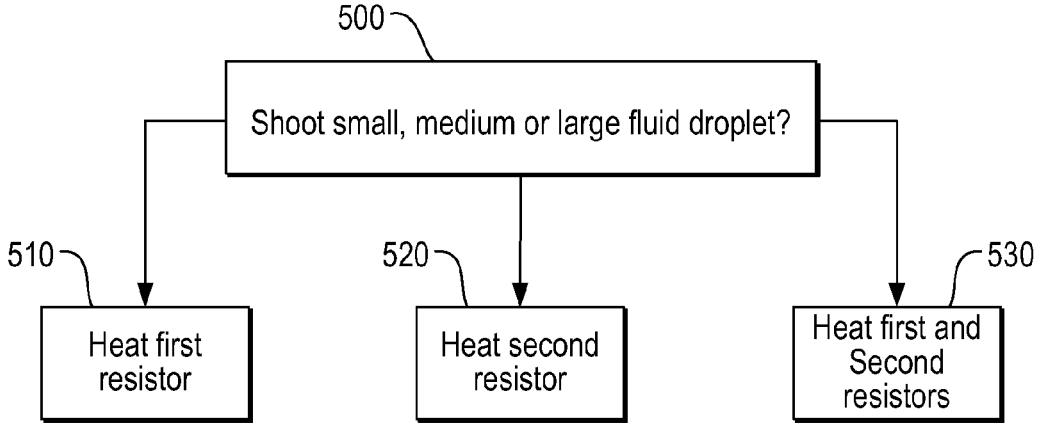

In one example, with reference to FIG. 1 (*a*), the first resistor is tuned to produce a larger fluid droplet than the second resistor. Firing the first resistor will produce a larger fluid droplet and firing the second resistor will produce a relatively smaller fluid droplet. FIG. 3 (*a*) shows a method of ejecting fluid which selectively produces smaller or larger fluid droplets according to the desired size. At block 300 it is determined which size of fluid droplet to fire (e.g. smaller or larger). If a larger droplet is desired then at block 310 a first resistor (in the first resistor layer) is fired (heated by passing an electric current pulse through it). If a smaller droplet is desired then at block 320 a second resistor (in the second resistor layer) is fired. In an alternative arrangement the first resistor may be tuned to produce a smaller fluid droplet than the second resistor, in which case the method would be the other way round (i.e. the first resistor would be heated to produce the small droplet and the second resistor heated to produce the large droplet).

Having a first resistor in a first resistor layer and a second resistor in a second resistor layer, provides flexibility in the routing of signals and may in some cases make it possible to place the resistors closer together than if they were in the same layer. Further, while it is possible to vary the droplet size produced by resistors (in the same or different layers) by increasing the area or length of some of the resistors, and although such a technique is within the scope of the present disclosure, it may not be desirable in all cases as the real estate on the fluid ejection device may be limited. Thus, another advantage of having two resistor layers is that it makes it possible to have resistors of different resistance in the first and second layers simply by selecting a different thickness and/or material for one of the layers.

In general the resistance of a resistor is given by the equation:—

$$R = \frac{\rho}{t} \times \frac{L}{W}$$

Where
R=resistance
ρ=resistivity
t=thickness
L=length
W=width

For instance, in the example of FIG. 1 (*b*) the first resistor 65 can be made to have a higher resistance than the second resistor 85, by making the layer 61 from a higher resistivity material than the layer 81. Similarly, even if the layers 61 and 81 are made from the same material, the first resistor 65 may be made to have a higher resistance by making the layer 61 thinner (and thus of higher resistance) than the layer 81.

Stated more generally the parameter $$\frac{\rho}{t}$$

is known as 'sheet resistance'. In most cases, due to the manufacturing process (e.g. PVD), the material and thickness of any one layer (61, 62, 81, 82) of the fluid ejection device will be constant throughout the layer; so the layer will have a set sheet resistance. By choosing the material and thickness such that layers 61 and 81 have different sheet resistances, resistors 65 and 85 will have different resistances even if they have the same length and width.

Thus, one advantage of having two separate resistor layers is that they may have different sheet resistances and thus contain resistors having different resistances. In contrast, if there was only one resistor layer then in general the sheet resistance would be constant and it might be necessary to significantly vary the length or width of resistors in order to vary the size of fluid droplet they produce for a given current pulse.

Any suitable conductive materials (including but not limited to metals and alloys of metals) may be used for the first, second, third and fourth conductive layers 61, 62, 81, 82. In one example the second and fourth conductive layers 62 and 82 are made of the same material; e.g. a copper based material such as AlCu. Examples of suitable materials for the first and third conductive layers 61 and 81 include, but are not limited to, TaAl, WSiN and TaSiN.

Figure 2:
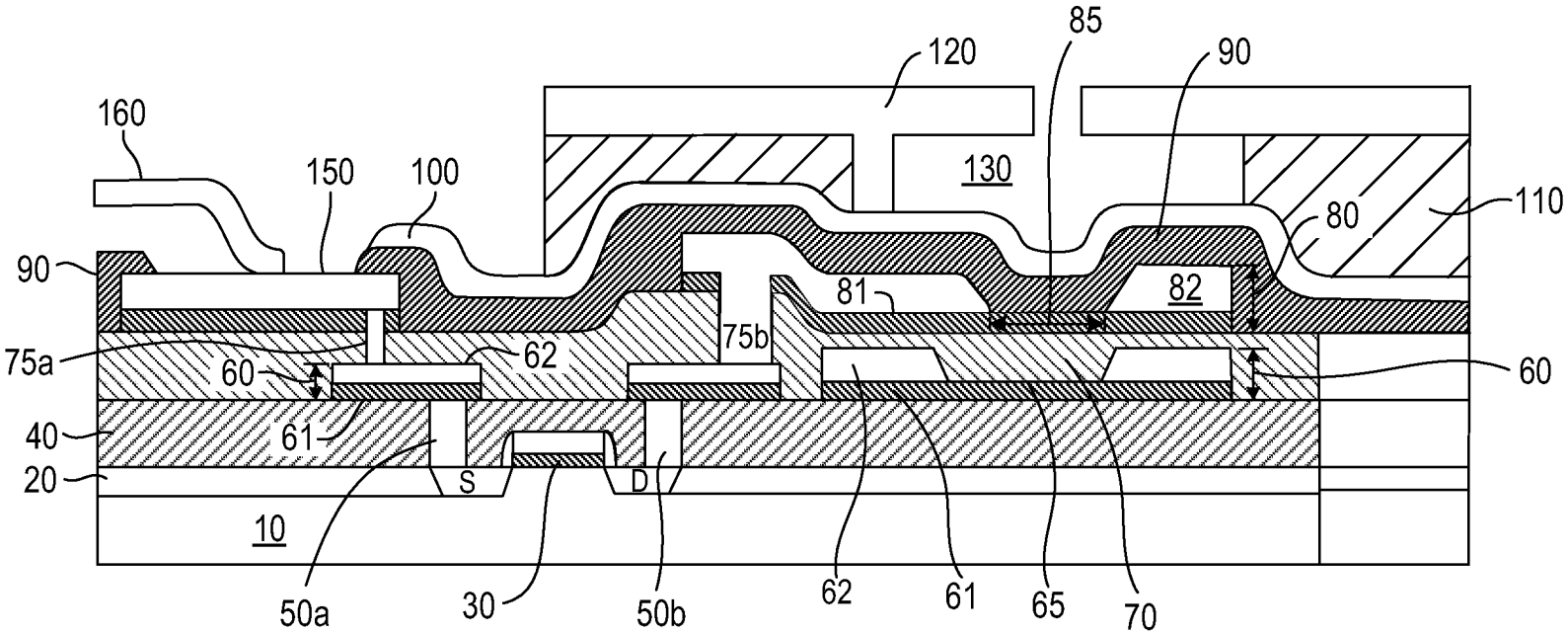
FIG. 2 is a cross sectional diagram of part of a fluid ejection device with stacked resistors according to the present disclosure.

FIG. 2 is a cross section of part of a fluid ejection device similar to FIG. 1, but with a pair of stacked resistors. The same reference numerals are used to indicate the same parts. By 'stacked' it is meant that the first resistor 65 at least partially overlaps the second resistor 85. In one implementation the first and second resistors 65, 85 may have the same resistance (e.g. be of the same material, length and thickness) and area and thus produce the same size of fluid droplet when individually fired. However, even though they have the same resistance, because the first and second resistors are stacked, at least two different size fluid droplets may be produced. FIG. 3 (*b*) shows how.

At block 400 it is determined whether a relatively larger or smaller fluid droplet is required. If a smaller fluid droplet is required then at 410 either the first resistor or the second resistor is fired. If a larger fluid droplet is required then at 420 both the first and second resistors are fired simultaneously. As the resistors are stacked their heat on firing is delivered to the same chamber resulting in a larger bubble and a larger fluid droplet is ejected when both resistors are fired at once.

In a variant on the above example, the first and second resistors 65, 85 may have different resistances. For example, the difference in resistance may be due to different sheet resistances of the first and third layers 61, 81 and/or because of different widths or lengths of the first and second resistors. As the stacked resistors have different resistances, three different sizes of fluid droplet may be produced as shown in FIG. 3 (*c*). For the purposes of this example we shall assume that the second resistor has a higher resistance than the first resistor.

At block 500 it is determined whether a fluid droplet having a first size, second size or third size is required. For convenience these will be termed 'small', 'medium' and 'large' fluid droplets in the following description, although it is to be understood that these terms describe the size relative to each other.

If a small fluid droplet is required then the first resistor is fired at block 510. If a medium size fluid droplet is required then the method proceeds to block 520 instead and the second resistor is fired. If a large fluid droplet is required then the method proceeds to block 530 and both the first and second resistors are fired together.

While in the above example the first resistor is tuned to produce a smaller droplet (e.g. has a smaller resistance) than the second resistor, it is to be appreciated that in an alternative configuration the first resistor could be tuned to produce a larger droplet than the second resistor. In that case the second resistor would be fired at block 510 and the first resistor fired at block 520.

In the examples above, the resistor (or resistors) are heated for the purpose of causing some of the fluid in the chamber to vaporize forming a bubble and ejecting an fluid droplet. However in any of the above examples, rather than heating the resistor (or resistors) to eject a fluid droplet, one or more resistors can be heated for the purpose of 'pre-heating' fluid in the fluid chamber. Pre-heating the fluid means heating the fluid sufficiently to raise its temperature to a desired range (or maintain it in that range) but not enough to cause a fluid droplet to be ejected. Some designs of fluid ejection device operate optimally when the fluid in the fluid chamber is maintained within a certain temperate range, and thus 'pre-heating' the fluid is a useful function. Typically a higher amplitude or duration of current pulse may be used to eject a fluid droplet, compared to the amplitude or duration of current pulse for pre-heating the fluid.

While various fluid ejection and pre-heating methods have been described above, it is to be understood that these could be implemented by circuitry to direct and/or generate appropriate electrical signals (current pulses) to the resistors. The circuitry may be comprise conducting lines for routing the signals and/or dedicated circuitry or a processor for receiving or generating the signals.

Figure 4A:
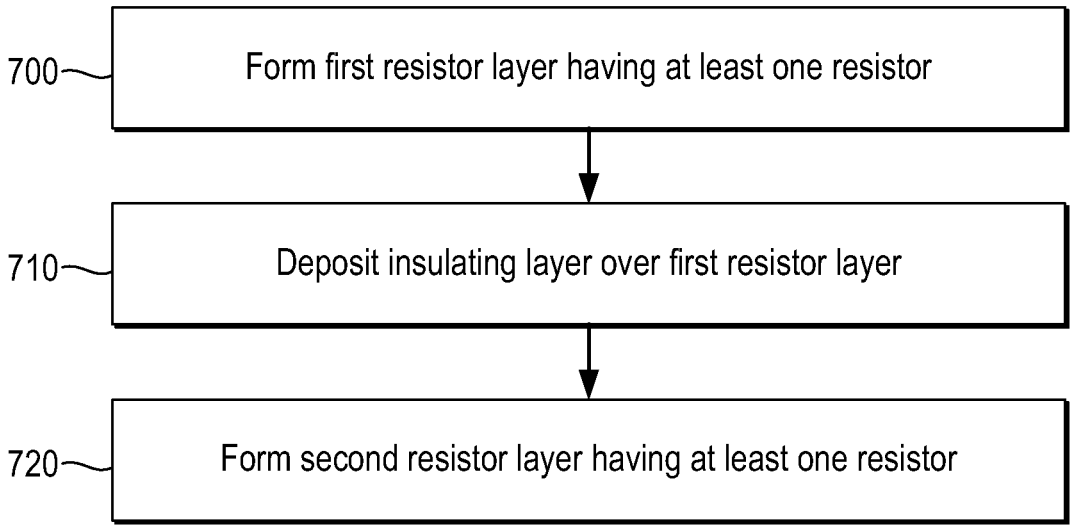
FIG. 4 (*a*) is a flowchart of a method of manufacturing a fluid ejection device according to the present disclosure.
Figure 4B:
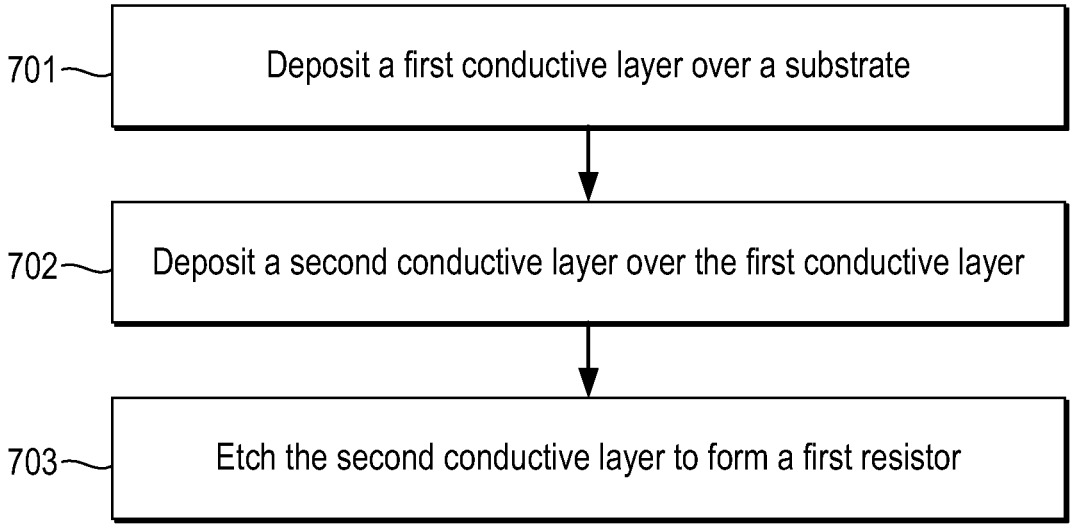
Figure 4C:
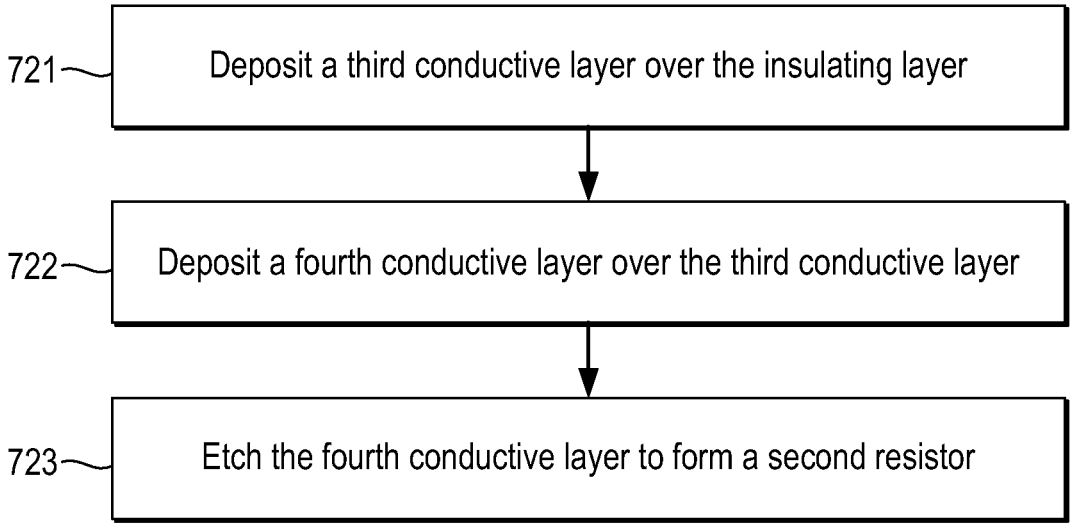

By way of example, a method of manufacturing the fluid ejection devices will now be described. FIG. 4 (*a*) is a flow chart showing a method of manufacturing part of a fluid ejection device such as that shown in FIGS. 1 (*a*) and 2.

At block 700 a first resistor layer is formed, the layer having at least one resistor.

At block 710 an electrically insulating layer 70 is deposited over the first resistor layer. Any suitable insulating material may be used for the electrically insulating layer, such as but not limited to silicon dioxide.

At block 720 a second resistor layer is formed over the insulating layer, the layer having at least one resistor.

FIG. 4 (*b*) shows an example of a method for forming the first resistor layer in more detail. At block 701 a first conductive layer 61 is deposited over a substrate 10.

The substrate 10 may be made of any suitable substrate material, such as but not limited to silicon. The first conductive layer 61 may be made of any suitable material, such as but not limited to TaAl, WSiN or TaSiN. There may be one or more intermediate layers between the first conductive layer 61 and the substrate 10. For example, as shown in FIG. 1, there may be an insulating layer (e.g. silicon dioxide), one or more transistors and a thermally and electrically insulating layer (for instance but not limited to silicon dioxide) between the first conductive layer 61 and the substrate. These layers and the subsequent layers described below may be deposited by any suitable deposition process, PVD or PECVD for instance.

At block 702 a second conductive layer 62 is deposited over the first conductive layer. The second conductive layer is of a different material to the second conductive layer and has a lower sheet resistance. Any suitable material may be used, for instance copper based materials including but not limited to AlCu.

At block 703 the second conductive layer is etched to form at least one resistor. That is, as shown in FIG. 1 (*b*), a portion of the second conductive layer is etched away so that a length of the first conductive layer links two separate portions of the second conductive layer. Any current passing between the two separate portions of the second conductive layer passes through the linking portion of the first conductive layer which acts as a resistor as it has a higher sheet resistance than the first conductive layer.

Many separate resistors may be formed by etching various parts of the second conductive layer at 703. Any suitable etching process may be used, such as but not limited to application of a photo-resist mask and chemical or plasma etching. In one example a sloped etch process is used so that the thickness of the first conductive layer is tapered and decreases by a gradual slope as shown in FIG. 1 (*b*).

While not shown in the flow diagram of FIG. 4 (*b*), at this point via holes may be formed in the insulating layer to allow electrical contact of the second conductive layer with upper layers of the fluid ejection device.

The method of FIG. 4 (*b*) is just an example of forming the first resistor layer and alternative approaches may be used. For example if it is desired to form a resistor having the structure shown in FIG. 1 (*d*) then the second conductive layer (having the lower sheet resistance) may be deposited first and then etched to form a gap at the desired location of the resistor and then the first conductive layer (having the higher sheet resistance) deposited in the gap.

FIG. 4 (*c*) shows an example of one method of forming the second resistor layer in more detail. At block 721 a third conductive layer 81 is deposited over the insulating layer 70.

The third conductive layer 81 may have the same or different composition to the first conductive layer 61. It may have the same or a different thickness to the first conductive layer.

At block 722 a fourth conductive layer 82 is deposited over the third conductive layer 81. The fourth conductive layer is composed of a different material to the third conductive layer and has a lower sheet resistance than the third conductive layer. The fourth conductive layer may have the same or a different composition to the second conductive layer.

At block 723 at least one second resistor is formed by etching the fourth conductive layer, in much the same way as the first resistor described in block 703.

Many second resistors may be formed by etching various parts of the fourth conductive layer at block 723. Of course the method of FIG. 4 (*c*) is just an example and other approaches are possible. For example the fourth conductive layer may be deposited first and etched, followed by depositing the third conductive layer (having higher sheet resistance) to form a resistor structure similar to that shown in FIG. 1 (*d*).

Further subsequent layers may be added after the second layer has been formed. For example an electrically insulating layer and an anti-cavitation layer may be deposited. Further, a barrier layer and a fluid ejection device plate may be added, as well as drilling or otherwise forming a hole in the barrier layer to form the fluid chamber. Bond pads, bonding wires and various control circuitry may also be added.

Portions of the first and second resistor layers may be used for routing signals. Further, there may in addition be one or more signal routing layers (formed of conductive material and used for routing signals but not heating fluid) below the first and second resistor layers (or even between or above the first and second resistor layers, although for the purposes of thermal conduction it is advantageous to place any such routing layers below the resistor layers).

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The preceding description has been presented only to illustrate and describe examples of the principles described herein. This description is not intended to be exhaustive or to limit these principles to any precise form disclosed. Many modifications and variations are possible in light of the above teaching and within the scope of the claims. For example there may be more than one intermediate layer between the first and second resistor layers. Further, while the examples above have shown two resistor layers, each having one or more resistors for heating fluid, there could be three or more resistor layers each having resistors for heating fluid.

What is claimed is:

1. A thermal fluid ejection device comprising:

a first resistor layer comprising at least a first resistor thermally coupled to a chamber to heat a fluid;

a second resistor layer comprising at least a second resistor thermally coupled to the chamber to heat the fluid; and an electrically insulating layer between said first and second resistor layers.

2. The fluid ejection device of claim 1 wherein said first and second resistors have different resistances.

3. The fluid ejection device of claim 1 wherein said first and second resistors have the same resistance.

4. The fluid ejection device of claim 1 wherein the first and second resistor layers have different thicknesses.

5. The fluid ejection device of claim 1 wherein the first and second resistor layers are formed from different materials.

6. The fluid ejection device of claim 1 wherein the first and second resistors are stacked such that said second resistor at least partially overlaps said first resistor with at least said electrically insulating layer between the first and second resistors.

7. The fluid ejection device of claim 1 wherein the first and second resistor layers comprise metals selected from the group comprising TaAl, WSiN and TaSiN.

8. The fluid ejection device of claim 1 wherein the first resistor layer comprises a first conductive layer and a second conductive layer; the first conductive layer having higher sheet resistance than the second conductive layer and wherein said first resistor comprises a portion of the first conductive layer which links two separate portions of the second conductive layer.

9. The fluid ejection device of claim 1 wherein the second resistor layer comprises a third conductive layer and a fourth conductive layer; the third conductive layer having higher sheet resistance than the fourth conductive layer and the second resistor comprises a portion of the third conductive layer which links two separate portions of the fourth conductive layer.

10. The fluid ejection device of claim 1 wherein one of said first and second resistors is tuned to produce a first fluid droplet and the other of said first and second resistors is tuned to produce a second fluid droplet of a relatively different volume than the first fluid droplet, and wherein the fluid ejection device comprises circuitry to fire a different sized fluid droplet by heating the one of the first and second resistors which is tuned to produce a second fluid droplet and to fire a first fluid droplet by heating the one of the first and second resistors which is tuned to produce a first fluid droplet.

11. The fluid ejection device of claim 1 comprising circuitry to fire a fluid droplet by heating one of the first or second resistors and to fire a fluid droplet of a relatively larger volume by heating both the first and second resistors together.

12. The fluid ejection device of claim 1 wherein the first and second resistors are stacked such that the second resistor at least partially overlaps the first resistor; and wherein the fluid ejection device comprises circuitry to heat the first resistor so as to fire a fluid droplet having a first size, to heat the second resistor so as to fire a fluid droplet having a second size and to heat both the first and second resistors so as to fire a fluid droplet having a third size.

13. The fluid ejection device of claim 1 comprising circuitry to pass electric current through the first and/or second resistor so as to pre-heat fluid in a chamber above the first and/or second resistor.

14. A method of manufacturing a fluid ejection device comprising:

forming a first resistor layer comprising at least one resistor to heat a fluid;

depositing an electrically insulating layer over the first resistor layer;

forming a second resistor layer over the electrically insulating layer, said second resistor layer comprising at least one resistor to heat a fluid.

15. A method of ejecting fluid comprising:

with a fluid ejection device comprising:

a first resistor layer comprising a first resistor to heat a fluid, a second resistor layer comprising a second resistor to heat a fluid; and an insulating layer between said first and second resistor layers;

selectively using electric current to heat one of said first and second resistors to produce a smaller fluid droplet, and the other of said first and second resistors or both of said first and second resistors to produce a larger fluid droplet according to the desired size of fluid droplet.

16. A print cartridge for a printer, the print cartridge comprising;

a fluid container and a printhead comprising:

at least one nozzle;

a first resistor layer comprising at least a first resistor to heat a fluid;

a second resistor layer comprising at least a second resistor to heat a fluid; and an electrically insulating layer between said first and second resistor layers.

17. The print cartridge of claim 16, further comprising print cartridge circuitry that direct electrical signals to be sent to the first and second resistors.

18. The print cartridge of claim 16, in which, with the print cartridge circuitry, one of the first and second resistors is tuned to produce a relatively larger fluid droplet than the other of the first and second resistors by:

heating the one of the first and second resistors; the one of the first and second resistors being tuned to produce a smaller fluid droplet; and heating the other of the first and second resistors; the other of the first and second resistors being tuned to produce a relatively larger fluid droplet.

19. The print cartridge of claim 16, in which the first and second resistors are stacked such that said second resistor at least partially overlaps said first resistor;

in which the print cartridge circuitry produces a relatively larger fluid droplet by heating both the first and the second resistors together; and in which the print cartridge circuitry produces a relatively smaller fluid droplet by firing one of the first and second resistors.

* * * * *

UNITED STATES PATENT AND TRADEMARK OFFICE

CERTIFICATE OF CORRECTION

PATENT NO. : 8,449,079 B2
APPLICATION NO. : 13/231634
DATED : May 28, 2013
INVENTOR(S) : Ning Ge et al.

It is certified that error appears in the above-identified patent and that said Letters Patent is hereby corrected as shown below:

In the Claims:

In column 9, line 42, in Claim 14, delete “layer:” and insert -- layer; and --, therefor.

Signed and Sealed this
Twentieth Day of August, 2013

Teresa Stanek Rea
*Acting Director of the United States Patent and Trademark Office*